United States Patent [19]

Smulka

[11] Patent Number: 4,581,503

[45] Date of Patent: Apr. 8, 1986

[54] HUMIDITY CONTROL WITH ADJUSTMENT FOR VARIATIONS IN ELEMENT SENSITIVITY

[75] Inventor: Roman Smulka, Minneapolis, Minn.

[73] Assignee: Honeywell Inc., Minneapolis, Minn.

[21] Appl. No.: 703,076

[22] Filed: Feb. 19, 1985

[51] Int. Cl.[4] ..... H01H 35/42

[52] U.S. Cl. ..... 200/61.06

[58] Field of Search ..... 200/61.04–61.06; 236/44 R, 44 A, 44 C; 73/336, 336.5, 337

[56] References Cited

U.S. PATENT DOCUMENTS

| | | | |
|---|---|---|---|
| Re. 30,485 | 1/1981 | Attridge, Jr. et al. | 236/44 C |
| 1,960,020 | 5/1934 | McGall | 200/67 |
| 2,866,023 | 12/1958 | Booth | 200/61.06 |
| 2,974,209 | 3/1961 | McMichael | 337/300 |
| 3,091,674 | 5/1963 | Harris | 200/61.06 |
| 3,115,557 | 12/1963 | Kjellman | 200/61.06 |
| 3,163,729 | 12/1964 | Flagg | 200/61.06 X |
| 3,270,153 | 8/1966 | Buchanan | 200/61.06 |
| 3,288,961 | 11/1966 | Thompson | 200/61.06 |
| 3,332,620 | 7/1967 | Streed | 236/44 A |
| 3,454,732 | 7/1969 | Liebermann | 200/61.06 |
| 3,763,338 | 10/1973 | Tozer | 200/61.06 |
| 3,949,607 | 4/1976 | Nodolf | 73/336 |

*Primary Examiner*—J. R. Scott

*Attorney, Agent, or Firm*—Clyde C. Blinn

[57] ABSTRACT

A humidity control having a Nylon ribbon sensing element which changes in length with moisture changes has an adjustable connecting member for changing the effect of the element on an operated switch to compensate for different expansion rates of manufactured elements.

11 Claims, 5 Drawing Figures

HUMIDITY CONTROL WITH ADJUSTMENT FOR VARIATIONS IN ELEMENT SENSITIVITY

BACKGROUND AND SUMMARY OF THE INVENTION

For many years humidity control devices have used Nylon strips or ribbons as a moisture responsive element such as shown in the Keith M. Nodolf U.S. Pat. No. 3,949,607, issued April 13, 1976, and the Maynard L. Thompson U.S. Pat. No. 3,288,961, issued November 29, 1966. While the normal calibration of such humidity controls or humidity responsive devices has been accomplished by a screw connecting a pivoted lever supporting the element to an adjusting member or cam, such calibration adjustment is not sufficient to compensate for changes in the rate of expansion of such Nylon strip elements. The present invention is concerned with an additional adjustment which can be made prior to the normal calibration of the humidity responsive device to adjust for the variations in rate of expansion of such elements.

Specifically, the adjustment characteristics of the humidity responsive device is changed by an additional lever engaging the humidity set point adjusting cam to provide for variations in the output of the adjustment to compensate for different characteristics of the Nylon element. A variation of an $L_1/L_2$ ratio makes possible (1) the adaptation of the same cam to sensing elements of different activities, and (2) the adaptation of the same cam and sensing element to variations in scales.

DESCRIPTION OF THE PREFERRED EMBODIMENT OF THE INVENTION

Figure 1:
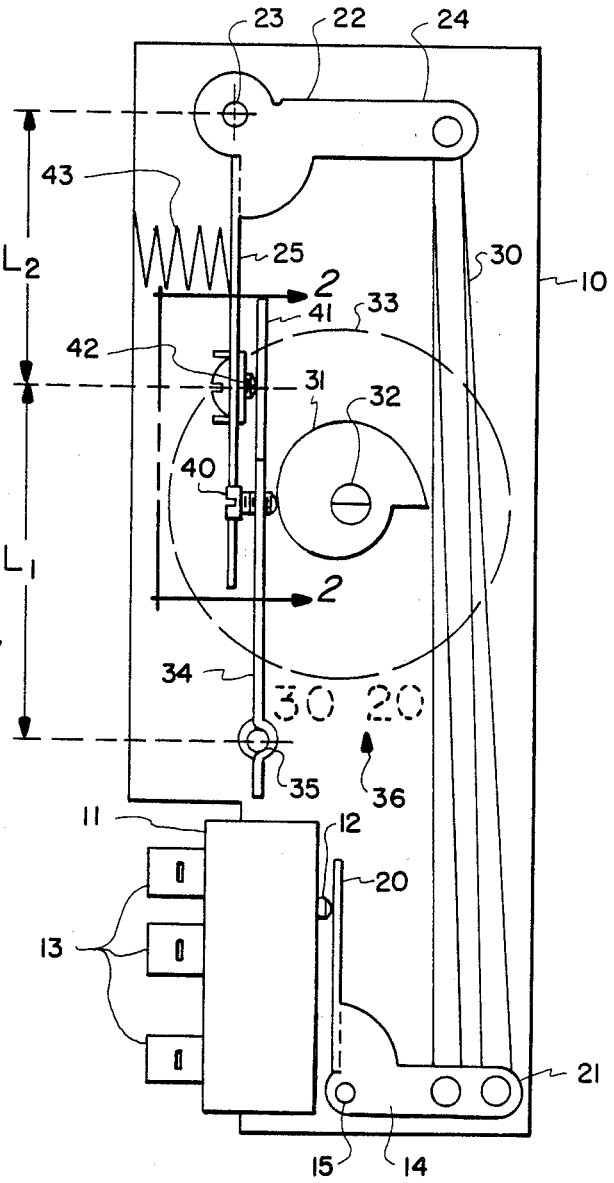
FIG. 1 is a side view of the humidity responsive device.

Referring to FIG. 1, a humidity responsive control or device has a housing or base 10 for supporting various components. Mounted on the base is an electrical output means or micro switch 11 of the type shown in the McGall U.S. Pat. No. 1,960,020 having an operating button 12 which, when pushed inward, provides for the proper opening or closing of the circuits attached to terminals 13. Switch 11 might be of the type to have the push button 12 spring biased outward so that when it is moved inward to the left the mechanism snaps over center to provide the electrical switch operation. A switch operating lever 14 is pivotally mounted at 15 on the base 10 and has an extremity 20 engaging button 12 and an extremity 21. An adjusting lever 22 at the opposite end of base 10 is pivotally supported at 23 on the base and has an extremity 24 and a lever 25. Mounted between extremities 21 and 24 is a moisture responsive element or Nylon strip 30 which expands in length as the moisture in the surrounding air increases. While element 30 might be a Nylon strip, other types of moisture elements such as human hair can be used.

An adjusting member or cam 31 is pivotally mounted on the base at 32 and connected by a shaft pivotally supported by base 10 to a control adjusting knob 33 cooperating with a scale 36 for setting a humidity set point for the control device. Cam 31 has a radius in a plane parallel to the plane of movement of said adjusting lever 22. A first lever 34 pivotally supported at one extremity at pivot 35 on base 10 has an adjusting or calibrating screw 40 positioned against the surface of cam 31 and has a further extension 41 away from pivot 35. A contact or engaging screw member 42 on lever 25 engages lever 34 along its extended portion 41 when adjusting member 22 is biased by a spring 43 counterclockwise to tighten element 30 and hold screw 42 against lever 41.

Figure 2:
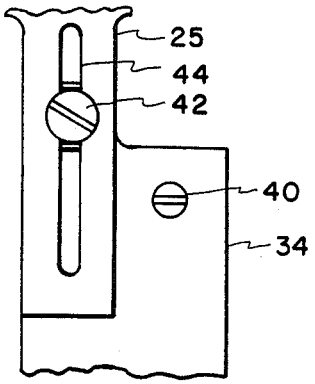
FIG. 2 is a showing of the two piece adjusting lever looking at the device of FIG. 1 along section line 2—2 from the right.

By movement of screw 42 along lever 25 in an opening 44 of lever 25 as shown in FIG. 2, the respective operating length of lever 34 ($L_1$) and lever 25 ($L_2$) can be changed to compensate for the rate of change of element 30 for changes in moisture level.

Figure 3:
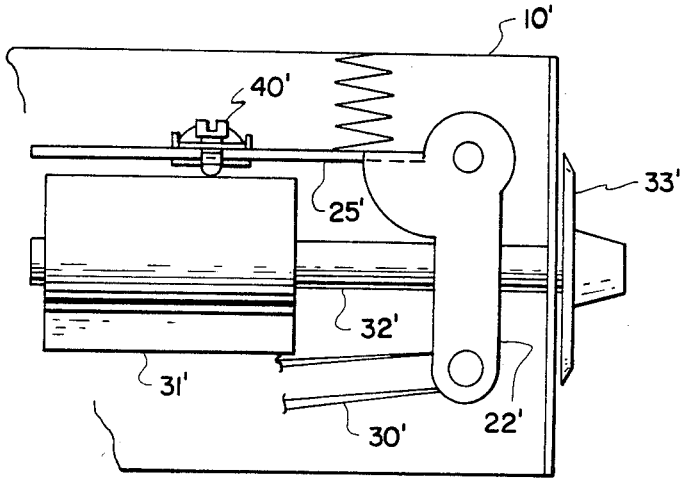
FIG. 3 is a second embodiment of the invention.
Figure 4:
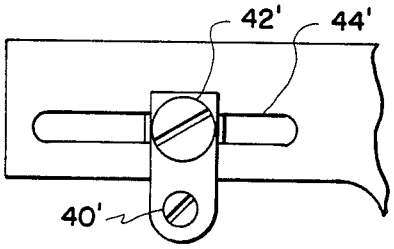
FIG. 4 is a portion of the embodiment shown in FIG. 3.

Another embodiment of the invention is disclosed in FIGS. 3 and 4. Cam 31' is attached to a shaft 32' mounted lengthwise in base 10' wherein only the length of liner 25' is changed; that is distance L. Cam 31' has a radius in a plane perpendicular to the plane in which lever 25' moves. Other parts of this embodiment are numbered with corresponding primed number as in FIG. 1.

Figure 5:
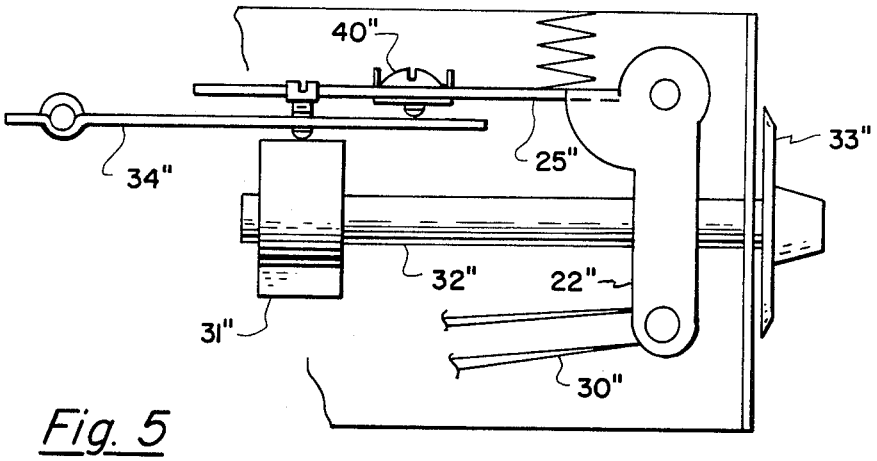
FIG. 5 is another embodiment of the invention.

A third embodiment of the invention is disclosed in FIG. 5 with two levers 25'' and 34'' as in the embodiment of FIG. 1 with a cam 31'' similar to that of FIG. 3 attached to a control knob 33'' by shaft 32''. Cam 31'' has a radius in a plane perpendicular to a plane of movement of lever 34''. Other parts of the third embodiment are numbered with corresponding double primed numbers as in FIG. 1.

OPERATION OF THE INVENTION

When the control device of FIG. 1 is connected electrically by terminal 13 to humidity or dehumidification apparatus, the operation of switch 11 would maintain the humidity in the space containing the control device as set by the set point knob 33. As the humidity element 30 changes in length with changes in the moisture content of the air surrounding the element, switch 11 is operated.

Cam 31 is designed to provide the proper adjustment of the adjusting lever 22 for the scale associated with knob 33. If the element is the same for each humidity control manufactured, other than the normal calibration which would be accomplished by screw 40, no adjustment of the length of the levers would be necessary. Humidity elements of the type used for element 30 are not consistently the same; in fact, various batches of Nylon elements having the same lengths may vary in their change in length for a given change in humidity. To accommodate such changes in different batches of elements 30, the contour of cam 31 would have to be changed or the scale associated with knob 33 would be changed. Such would be the case in conventional prior art humidity controls using a single extension of the adjusting member 22 as done in the Nodolf patent.

By means of the split lever made up of lever 34 and lever 25, the ratio of the distances $L_1$ and $L_2$ is directly proportional to the activity level of the element 30, hence the ratio can be adjusted to the individual element's properties.

During the manufacture of the humidity responsive control, as shown in FIG. 1, with a certain batch of elements 30, the ratio of $L_1$ to $L_2$ is set to make the scale associated with the knob 33 apply to the range of humidities and movement of element 30 for the design of cam 31. Thereafter, the control can be calibrated at a particular humidity by the calibration screw 40. Let us assume that another batch of humidity elements such as Nylon element 30 is received which has a different rate of change in length for a given change in humidity. Rather than redesign the cam 31 or change the spread of the scale associated with the knob 33, the ratio of $L_1$ to $L_2$ is changed by moving the pivot point or screw 42 up or down as shown in FIG. 2 to accommodate the new property of the humidity element 30.

Such an invention greatly reduces the cost of manufacture as batches of Nylon humidity elements such as 30 vary greatly from batch to batch, and if it were necessary to redesign the cam 31 or change the scale 36 for each control device depending upon the characteristics or properties of the element 30, the cost of manufacture would be greatly increased. As the batches of elements are found to have different properties, that is, the amount of change for a given change in humidity is different, rather than expand or change the scale 36 or modify the contour of cam 31, the change in properties of the element can be accommodated by the ratio of $L_1$ to $L_2$ and thus the adjustment of the pivot point or screw 42 before calibration of the control is accomplished.

For a given humidity element 30 with certain characteristics and for a certain cam 31 used in a control 10, the control may be to replace another control having new fixed scale such as scale 36 but not matching the response of the element. By adjustment of the $L_1/L_2$ ratio, control 10 can be adapted to the new fixed scale. Such is often the case when control 10 is used to replace a competitive control where it is necessary to use the scale used with the competitive control.

While the present invention is described in one particular manner, the scope of the invention is intended only to be limited by the appendant claims in which I claim:

1. In a humidity responsive device, a base, switch means mounted on said base, said switch means having an operating means, a switch operating lever pivotally mounted on said base and having an extremity engaging said operating means, an adjusting lever, means pivotally mounting said adjusting lever on one end of said base, a moisture responsive element changing in length as the quantity of moisture in the surrounding air changes, means connecting said element between the free ends of said adjusting lever and said swtich operating lever, an adjusting member mounted on said base and attached to a control point setting means, connection means connecting said adjusting member for positioning said adjusting lever, said connection means comprising means for changing the movement of said adjusting lever for a predetermined movement of said adjusting member whereby the humidity responsive device is calibrated for various differences in the rate of change of the moisture responsive element for given changes in moisture level.

2. The invention of claim 1 wherein said means for changing comprises, a first lever means pivotally supported on said base and engaging said adjusting member, said first lever means having a free end, said adjusting lever having a free extremity a common contact point means to said free end and said free extremity establishes the movement of said adjusting lever for a predetermined adjustment of said adjusting means.

3. The invention of claim 2 wherein said common contact point means is an adjustable screw member for changing said contact point and thus the operating lengths of said free end and said free extremity.

4. The invention of claim 3 wherein said first lever means has a calibration screw engaging said adjusting member.

5. The invention of claim 4 wherein said adjusting member is a cam attached to a knob associated with a scale.

6. The invention of claim 2 wherein the length of said first lever means between said pivot support and said contact point is $L_1$ and the length of said free extremity between said pivot of said adjusting lever and said contact point means is $L_2$ whereby the ratio of $L_1$ to $L_2$ is directly related to the expansion properties of said element.

7. In a moisture responsive device, a base member, electrical output means mounted on said base member, said output means has a mechanical input means, operating lever means pivotally supported on said base member, said operating lever means having a portion for operating said mechanical input means and first free extremity, adjusting lever means pivotally supported on said base member, said adjusting lever means having a first lever and a second free extremity, moisture responsive means changing in length as the quantity of moisture in the surrounding air changes, means connecting said moisture responsive means between said first and second free extremities whereby upon a change in the quantity of moisture in the surrounding air said electrical output means is operated depending upon a setting of said adjusting lever means, moisture control set point adjusting means associated with a moisture scale for setting a predetermined moisture quantity, adjustable connection means connecting said adjusting means to said first lever of said adjusting lever means whereby said moisture responsive device can be calibrated to have said adjusting means matched for various rates of length change of said moisture responsive element.

8. The invention of claim 7 wherein, said adjusting means comprises a cam attached to a shaft pivotally supported on said base member, and means connected to said adjustable connection means for engaging said cam, and a second lever pivotally supported on said base member, said second lever engaging said cam and having an adjustable common engagement point means between said second lever and said first lever of said adjusting lever means.

9. The invention of claim 8 wherein said cam has a radius in a plane parallel to the plane in which said second lever moves.

10. The invention of claim 8 wherein said cam has a radius in a plane perpendicular to the plane in which said second lever moves.

11. The invention of claim 7 wherein said adjusting means comprises a cam attached to a shaft pivotally supported on said base, said cam has a radius in a plane perpendicular to a plane in which said first lever of said adjusting lever means moves, and adjustable contact means connected to said first lever for contacting the surface of said cam whereby movement of said adjustable contact means along the surface of said cam calibrates said device to match a scale associated with said adjusting means to the rate of change in length of said element.

* * * * *